US007905723B2

(12) United States Patent
Klobucar et al.

(10) Patent No.: US 7,905,723 B2
(45) Date of Patent: Mar. 15, 2011

(54) CONVECTION COMBUSTION OVEN

(75) Inventors: Joseph M. Klobucar, Ann Arbor, MI (US); James L. Pakkala, Livonia, MI (US); Guang Yu, Novi, MI (US)

(73) Assignee: Durr Systems, Inc., Plymouth, MI (US)

( * ) Notice: Subject to any disclaimer, the term of this patent is extended or adjusted under 35 U.S.C. 154(b) by 570 days.

(21) Appl. No.: 11/701,254

(22) Filed: Feb. 1, 2007

(65) Prior Publication Data

US 2007/0292815 A1 Dec. 20, 2007

Related U.S. Application Data

(60) Provisional application No. 60/814,632, filed on Jun. 16, 2006, provisional application No. 60/807,875, filed on Jul. 20, 2006, provisional application No. 60/839,082, filed on Aug. 21, 2006.

(51) Int. Cl.
*F27B 9/00* (2006.01)

(52) U.S. Cl. ..... 432/147; 432/148; 34/270

(58) Field of Classification Search ..... 432/17, 432/147, 148, 136, 175, 143, 62, 64; 126/21 A, 126/91 A, 21 R; 34/270, 215, 216, 266, 267
See application file for complete search history.

(56) References Cited

U.S. PATENT DOCUMENTS

| | | | | |
|---|---|---|---|---|
| 3,583,686 | A * | 6/1971 | Mackey | 432/62 |
| 4,092,100 | A | 5/1978 | Phillips | |
| 4,242,807 | A | 1/1981 | Braun | |
| 4,771,552 | A * | 9/1988 | Morioka | 34/222 |
| 4,878,480 | A | 11/1989 | Watson et al. | |
| 5,235,757 | A | 8/1993 | Josefsson et al. | |
| 5,456,023 | A * | 10/1995 | Farnan | 34/270 |
| 5,588,830 | A * | 12/1996 | Josefsson et al. | 432/147 |
| 5,661,912 | A * | 9/1997 | Bhatnagar et al. | 34/270 |
| 5,690,485 | A | 11/1997 | Mangham et al. | |
| 5,795,146 | A | 8/1998 | Orbeck | |
| 6,062,850 | A * | 5/2000 | Ino et al. | 432/143 |
| 6,946,163 | B2 * | 9/2005 | Hosokawa | 427/348 |
| 7,063,528 | B2 * | 6/2006 | Klobucar et al. | 432/147 |
| 7,200,953 | B2 * | 4/2007 | Sonner et al. | 34/225 |
| 7,384,482 | B2 * | 6/2008 | Hosokawa | 118/63 |

FOREIGN PATENT DOCUMENTS

JP 62213873 A 9/1987

OTHER PUBLICATIONS

International Search Report dated Oct. 1, 2007.

* cited by examiner

*Primary Examiner* — Gregory A Wilson
(74) *Attorney, Agent, or Firm* — Howard & Howard Attorneys PLLC

(57) ABSTRACT

An oven assembly for baking coatings applied to an object includes a housing with a header receiving pressurized air from a ventilator disposed outside the oven. A heater provides heat to the pressurized air received from the ventilator raising the temperature of the pressurized air to between about two and four times curing temperature in Fahrenheit degrees of the coatings applied to the object. The header extends from the heater into the housing. The header has nozzles disposed at spaced locations directing pressurized air at the temperature being between about two and four times the curing temperature in Fahrenheit degrees of the coating applied to the object toward predetermined locations on the object.

10 Claims, 5 Drawing Sheets

CONVECTION COMBUSTION OVEN

RELATED APPLICATIONS

This application claims priority to Provisional Application Nos. 60/814,632, filed Jun. 16, 2006, 60/807,875, filed Jul. 20, 2006, and 60/839,082, filed Aug. 21, 2006.

BACKGROUND OF THE INVENTION

The present invention relates toward an inventive oven for curing coatings applied to an object. More specifically, the present invention relates to a convection combustion oven having a simplified design for curing coatings applied to an object.

Various types of ovens are used to cure coatings, such as, for example, paint and sealers, that are applied to articles in a production setting. One example is decorative and protective paint that is applied to automotive vehicle bodies in a high volume paint shop known to process vehicle bodies at rates exceeding one per minute.

A typical oven uses combustion fuel to provide the necessary amount of heat to cure paint applied to a vehicle body. Generally two types of ovens are presently used, a convection oven and a radiant heat oven. Occasionally, a combination of convection and radiant heat is used in a single oven to meet paint curing specifications. A convection heat oven makes use of a heat source such as natural gas flame that heats pressurized air prior to delivering the heated air to an oven housing. A first type of convection heating applies combustion heat directly to pressurized air prior to delivery to the oven housing mixing combustion gases with the pressurized air. A second type of convection heating uses an indirect heating process where combustion heat is directed into a heat exchanger that heats the pressurized air without mixing the combustion gases with the pressurized air.

An alternative source of heat is provided inside the oven housing by a radiant heater that transfers heat to the vehicle body by way of proximity to the vehicle body. As known to those of skill in the art, a radiant heater is generally a metal panel that is heated by circulating hot air into a space located behind a radiator.

The conventional convection and radiant ovens have proven to be exceedingly expensive to construct and do not provide energy efficiencies desirable in today's high-cost energy market. A conventional oven design is generally shown at 10 in FIG. 1. The conventional oven assembly 10 generally includes two main components, a heater box 12 and an oven housing 14. The heater box 12 is generally spaced from the oven housing 14 and includes components (not shown) to provide heat and pressurized air to the oven housing 14 through hot air duct 16. The heater box 12 includes a return duct that draws a significant portion of air from the interior of the oven housing 14 for recirculation through the oven housing 14. Up to ninety percent of the air passing through the heater box 12 is derived from the interior of the oven housing 14 through return duct 16. Generally, only ten percent of the air delivered to the oven housing 14 through hot air duct 16 is fresh air drawn from outside the oven housing 14. Hot air is directed through hot air headers 20 toward the vehicle body through nozzles 22 to optimize a uniform heat transfer to cure the coating applied to the vehicle body. Generally, the vehicle body is heated to about 275-340° F. at a predetermined time to adequately cure the applied coating. Some coatings, such as electrodeposition primers, require temperatures at the higher end of this range. As is known to those of skill in the art, more heat must be directed toward heavy metal areas of the vehicle body to derive the desired baking temperature.

A typical oven zone of about eighty feet in length of a conventional oven requires an actual air volume of about 30,000 cfm when using a heater box. This high air volume is required to transfer the necessary heat to the vehicle body to cure the applied coating. The air temperature at the nozzle 22 in a conventional oven is generally 444° F. requiring an air velocity at the nozzle 22 of 4,930 fpm to transfer the desired amount of heat energy. The operating parameter set forth above generally provides 1,595,000 BTU/hr at a momentum of $4.9\times10^6$ ft-lb/sec$^2$. Because hot air is recirculated by the fan located in the heater box 12, and because the recirculated air is often reheated prior to being pressurized by the fan, the fan requires an overlying robust design adding to operation and installation costs.

The volumes and flow rates presently used in conventional ovens require heavy duty fans and heater systems that are not believed necessary to obtain the required heat transfer. This is in part due to the recirculation of hot air through the fan and back into the oven housing 12. Furthermore, due to the recirculation, a substantial amount of insulation 24 is required around the heater box 12 and the hot air duct 16 to reduce heat loss and protect workers from physical contact. Therefore, it would be desirable to design a simplified oven assembly that does not require extensive insulation and complex apparatus associated with conventional heater boxes.

SUMMARY OF THE INVENTION

The present invention discloses an oven assembly for curing a coating applied to an article being conveyed through the oven assembly. A transporter extends through an oven housing for conveying the article through the oven assembly. A fan provides pressurized air into the oven housing drawn substantially from outside the oven housing. A duct includes a first element extending into the oven housing and a second element interconnected with the fan for transporting pressurized air from the fan into the oven housing. A burner is disposed generally between the first element and the second element for heating the pressurized air being transported into the oven housing. The first element defines a plurality of air outlets spaced throughout the oven housing for directing heated air toward the article. The first element is substantially insulated inside the oven housing reducing the escape of heat generated by the burner from the duct except through the air outlet. The burner heats the pressurized air being directed into the oven housing to a temperature of about three times the curing temperature of the coating that is applied to the article.

The inventive oven assembly solves the problems associated with the prior art, or conventional oven assembly. Particularly, the size of the ventilator or fan used to provide pressurized air to the oven housing for transferring heat to the article being baked is significantly reduced for two reasons. First, the fan primarily draws ambient temperature air as the present design does not circulate heated air back into the oven housing and, therefore, does not need to be heat resistant. Furthermore, the heater or burner used to heat the ambient temperature air prior to the introduction to the first element of the duct is configured to heat the air to about two to four times the curing temperature of the coating applied to the vehicle body adjacent the oven housing. This temperature air, when introduced to the oven interior at a high nozzle velocity, reduces the air volume of a conventional 80 foot long oven zone from about 30,000 acfm to about 2,000 scfm. At this combination of air volume, air temperature, and air velocity, a substantially similar amount of BTUs per hour is delivered to the oven as a conventional oven while using less energy to drive the ventilator and having a significantly simplified ventilation and heating apparatus. Specifically, the complex heater box presently used in conventional ovens is no longer necessary and is, therefore, completely eliminated substantially simplifying the construction and design of a production oven.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
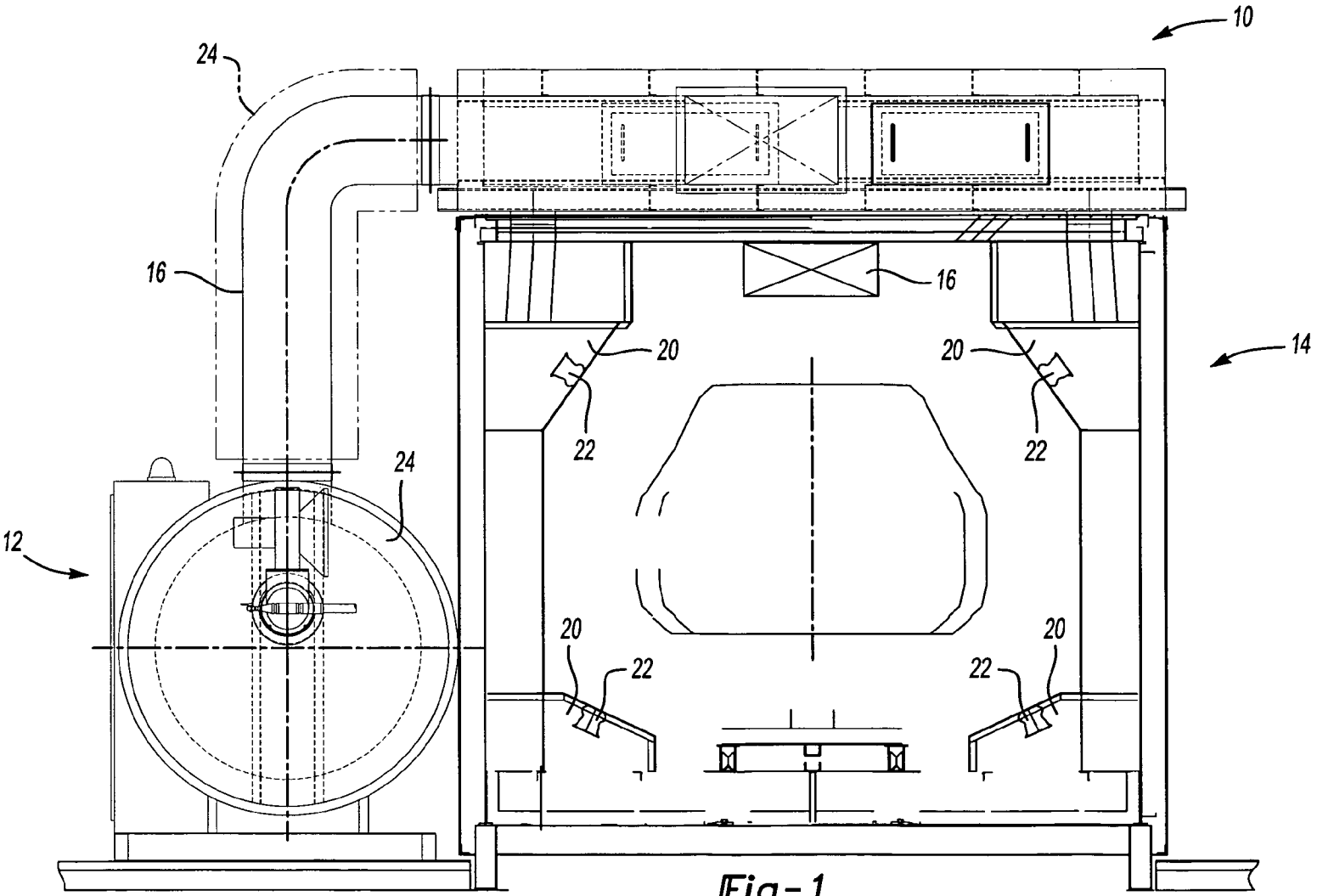
Fig-1 PRIOR ART
FIG. 1 shows a prior art oven assembly.

Referring to FIG. 1, an inventive oven assembly is generally shown at 30. The oven assembly includes an oven housing 32 through which an article such as, for example, a vehicle body 34 is conveyed on a transporter 36. The transporter 36, as is known to those of skill in the art, is generally designed as a conveyor that conveys a carrier 38 upon which the vehicle body 34 is secured.

In a production paint shop, a coating is applied to the vehicle body 34 providing decorative and protective paint finish to the vehicle body 34. Different coatings have different baking or curing requirements that, along with vehicle body type and production volume, dictate the length and thermal requirements of the inventive oven assembly 30. For example, electrodeposition primers typically cure at about 340° F. for about twenty minutes and decorative top coat and clear coats cure at about 285° F. also for about twenty minutes. For simplicity, the explanation of the inventive concepts of the present oven assembly 30 will assume a typical eighty foot long oven zone requiring a delivery of heat of about 1,595,000 British thermal minutes per hour (BTU/hr).

Pressurized air is delivered into the oven housing 32 through a duct 40 by a ventilator 42. Preferably, the ventilator 42 is a conventional fan capable of providing the transfer of ambient air at a volume of about 2,000 scfm. The duct 40 includes a first element 44 generally extending inside the oven housing 32 and a second element 46 generally extending from the ventilator 42 to the first element 44. A heater 48 is disposed between the first element 44 and the second element 46 to provide heat to the pressurized air passing through the duct 40 as delivered by the ventilator 42. Preferably, the heater 48 is a gas fired burner sized to provide the desired amount of heat to the pressurized air passing through the duct 40 to adequately cure the coating applied to the vehicle body 34. However, it should be understood by those of skill in the art, that alternative heaters may also be used to provide heat to the pressurized air as set forth above.

As will be explained further below, the heater increases the temperature of the pressurized air to about 1,100° F. or hotter. One range contemplated is between about 700° and 1,100° F. The desired temperature is selected to be between about two and four times the curing temperature of the coating as will be explained further below. The heater is located, preferably, adjacent to or nearly adjacent to the oven housing 32 so that the heated, pressurized air travels only through the interior of the oven housing 32. This reduces the need to insulate the duct 40, or more specifically, the second element 46 of the duct 40 further reducing assembly costs. However, insulation 50 covers the first element 44 of the duct 40 inside the oven housing 32 to prevent the escape of heat through the first element 44 into the oven housing 32 except where desired.

Figure 2:
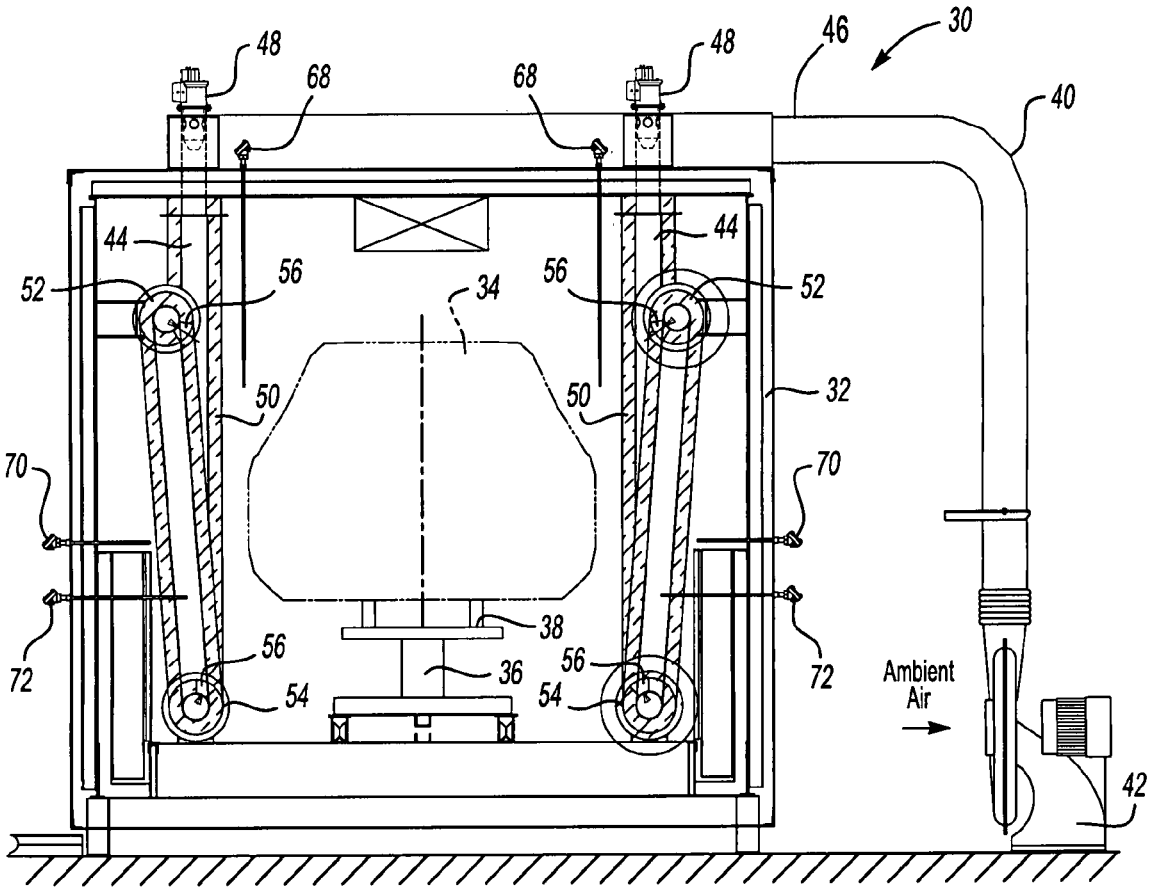
FIG. 2 shows an inventive oven assembly having two heaters positioned on opposing sides of an oven housing of the oven assembly, wherein each heater provides heat to opposing first elements.

The oven assembly 30 represented in FIG. 2 shows two heaters 48 positioned on opposing sides of the oven housing 32, each providing heat to opposing first elements 44. Therefore, the first element 44 of the duct 40 is disposed on opposing sides of the vehicle body 34 being transported through the oven housing 32. However, it should be understood that a single heater 48 is contemplated to provide heat to each of the opposing first elements 44 of the duct 40 by locating the heater 48 generally midway between each of the opposing first elements 44.

Figure 3:
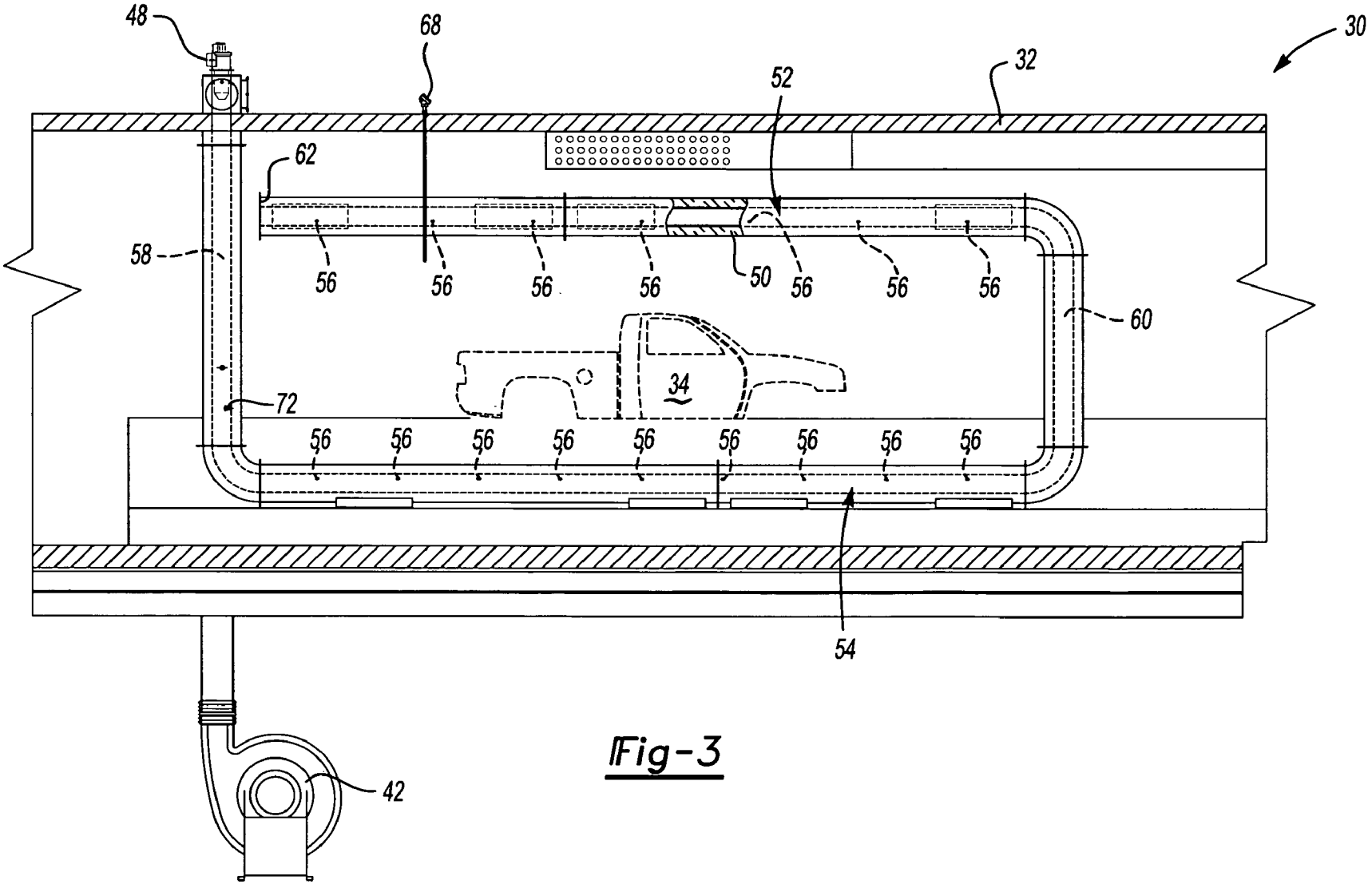
FIG. 3 represents the spaced locations of nozzles on an upper header and a lower header of the oven assembly.

Each first element 44 defines an upper header 52 and a lower header 54 that extend in a generally horizontal direction. Nozzles 56 are spaced along each of the upper header 52 and lower header 54 through which pressurized, heated air is projected toward predetermined locations on the vehicle body 34. FIG. 3 best represents the spaced locations of the nozzles 56 on the upper header 52 and lower header 54, the configuration of which will be explained further below. As best represented in FIG. 3, a feed header 58 extends between the heater 48 and the lower header 54 of the first element 44. The feed header 58 serves as a mixer providing distance between the first of the nozzles 56 and the heater 48 so that the combustion gases produced by the heater 48 have ample time to mix with the pressurized air provided by the ventilator 42. In this example, about eight feet in length of the feed header 58 has proven to provide ample mixing time for the combustion gases generated by the heater 48 in the pressurized air provided by the ventilator 42 for an eighty foot oven zone. Different size oven assemblies with different heat requirements may require different lengths of feed headers 58. The first element 44 shown in FIG. 3 shows in connection serially, the feed header 58 with the lower header 54, which is connected to the upper header 52 by a connection header 60. In this configuration, the pressurized air travels a single path through the feed header 58 to the lower header 54, through the connection header 60, terminating at a distal end 62 of the upper header 52. It should be understood by those of skill in the art that a heater 48 placed in a lower portion of the oven assembly 30 connects first to the upper header 52 via feed header 58 reversing the direction of the pressurized air through the first element 44.

Referring again to FIGS. 2 and 3, vertical temperature probes 68 extend downwardly from the roof of the oven housing 32 to measure the interior temperature of the oven housing 32. The vertical temperature probes 68 communicate with a controller (not shown) that signals the heaters 48 to adjust, when necessary, the interior temperature of the oven housing 32. Horizontal temperature probes 70 are spaced below the vertical temperature probes 68 and measure temperature in a similar manner as the vertical temperature probes 68 the temperature of the oven in the lower regions of the housing 32. Header temperature probes 72 extend into the feed header 58 to measure the temperature of the pressurized air inside the feed header 58 in a manner similar to that explained for the vertical temperature probe 68 above. Each of the probes interact with the controller to control the temperature of the interior of the oven housing 32. Additional header temperature probes 72 may be spaced along the second element 46 if necessary. For faster response, vertical or horizontal probes 68,70 may be located directly in front of a nozzle 56, spaced from the nozzle 56 between one to three feet.

Figure 4:
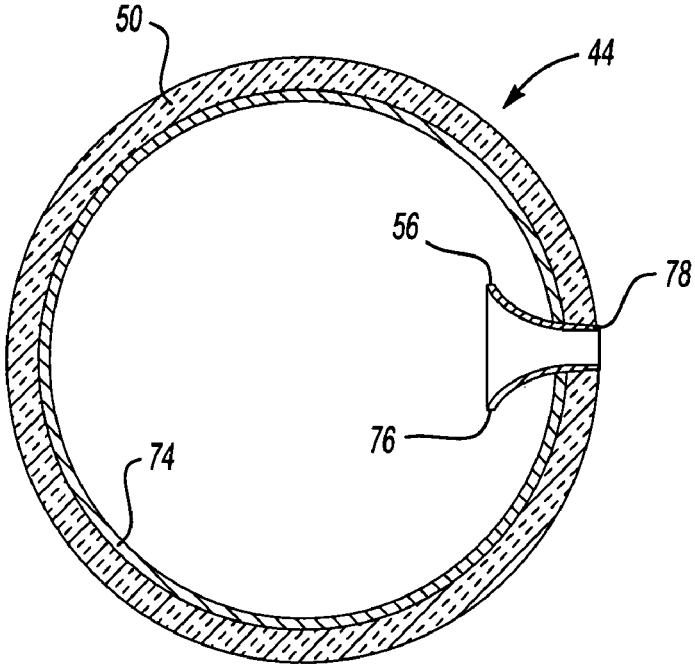
FIG. 4 represents a cross-sectional view of one of the upper header and lower header.
Figure 5A:
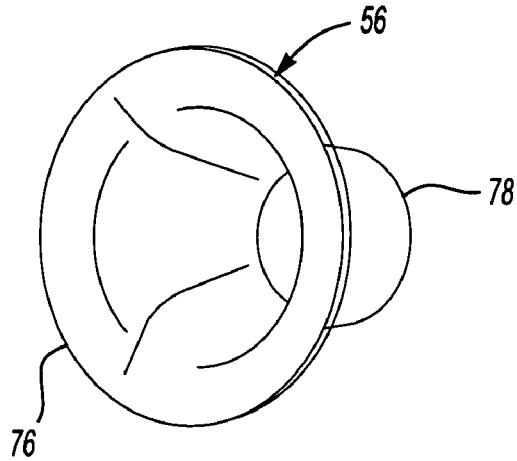
FIG. 5A represents a perspective view of the shape of the nozzles.
Figure 5B:
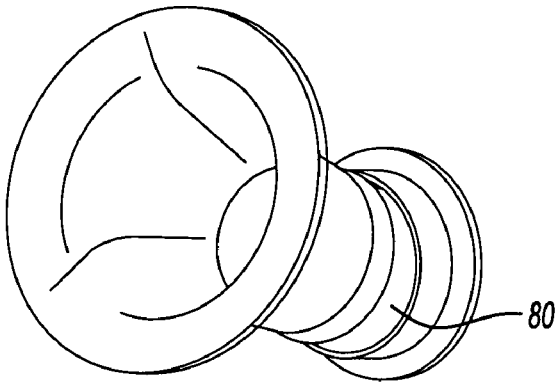
FIG. 5B shows an alternative nozzle having a swivel.

Referring to FIG. 4, a cross-sectional view of one of the upper header 52 and lower header 54 is shown. As set forth above, insulation 50 surrounds a header wall 74 reducing the heat loss through the header wall 74 into the oven housing 32. The nozzles 56 are located inside the header wall 74 and define a decreasing diameter from a distal end 76 toward a terminal end 78 located generally adjacent the header wall 74. Therefore, the nozzle 56 defines a generally concave, frustoconical shape so that the pressurized air passing through the nozzle 56 accelerates due to decreasing area upon exit from the first element 44. The shape of the nozzles 56 is best represented in the perspective view shown in FIG. 5A. FIG. 5B shows an alternative nozzle 57 having a swivel 80 that allows the alternative nozzle 57 to be articulated inside the first element 44 enabling the pressurized air to be directed to the predetermined location in a more accurate manner.

Figure 6:
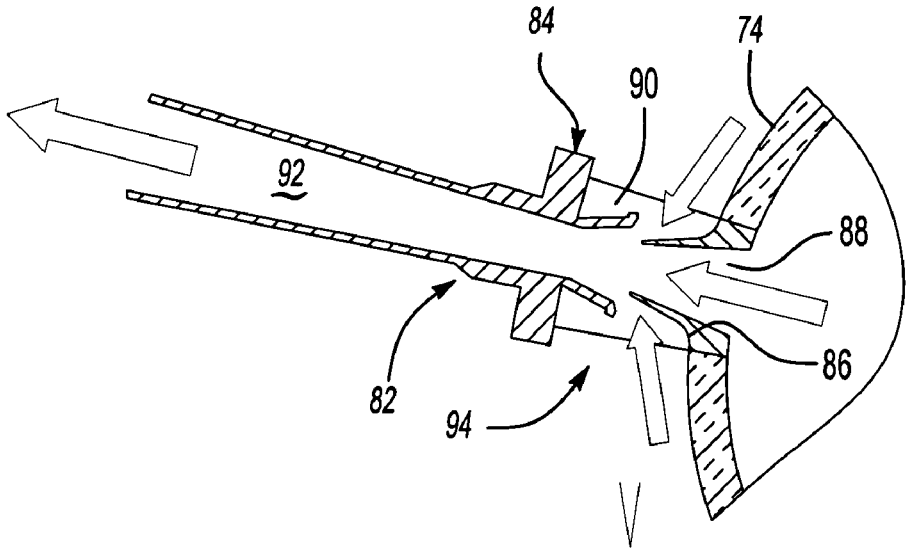
FIG. 6 shows an alternative nozzle in the form of an eductor or venturi nozzle.

An alternative nozzle in the form of an eductor or venturi nozzle is shown at 82 in FIG. 6. The eductor 82 is shown in FIG. 6 having a mating surface 86 that is affixed to header wall 74 outside of the header 52, 54. The mating surface 86 defines a pressurized air inlet 88 that receives pressurized air from one of the upper and lower header 52, 54. The pressurized air passes through venturi chamber 90 and exits the eductor 82 through eductor nozzle 92 directing the pressurized air toward the predetermined location of the vehicle body 34 as set forth above. Hot air is drawn from the interior of the oven housing 32 through venturi inlet 94 and is forced into the eductor nozzle 92 by the pressurized air passing through the venturi chamber 90 via venturi effect as is known. This increases the volumetric flow of air toward the predetermined location of the vehicle body 34 further reducing the energy requirements of the ventilator 42.

Figure 7:
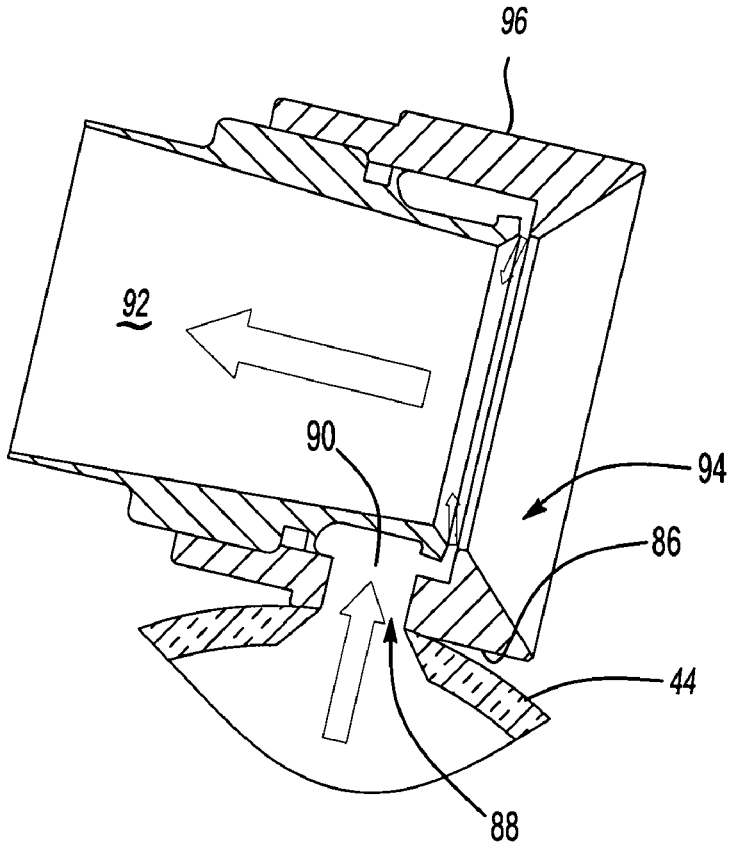
FIG. 7 shows still another alternative embodiment of the nozzle.

A further embodiment nozzle is shown as an air amplifier 96 at FIG. 7 where like numerals will be used with FIG. 6 for simplicity. The air amplifier 96 includes an air inlet 88 where pressurized air is forced from one of the upper and lower headers 52, 54. The pressurized air passes through the venturi chamber 90 and into the amplifier nozzle 92 and directs the pressurized air toward a predetermined location of the vehicle body 34. Heated air is drawn from the interior of the oven housing 32 through venturi inlet 94 via the venturi effect causing an increase in the volumetric flow of heated air directed toward the vehicle body 34 again reducing the energy requirements of the ventilator 42.

The embodiments set forth above are desirable to heat heavy metal areas of the vehicle body 34, which have higher heat requirements than thin or sheet metal areas of the vehicle body 34. In these embodiments, the eductor 84 and the air amplifier 96 are each directed at a predetermined location of the vehicle body drawing heated air from inside the oven housing 32 maximizing the amount of heat energy directed toward the heavy metal area of the vehicle body 34. As explained above, pressurized air passes through the header 52, 54 through air inlet 88 and into the venturi chamber 90 prior to exiting through the nozzle 92. Hot air is drawn into venturi inlet 94 via the venturi effect increasing the volumetric flow rate of hot air being directed toward the vehicle body 34.

Table 1 shows the operational parameters of the inventive oven assembly 30 that provides the benefits set forth above.

TABLE 1

| | | Conventional Oven Nominal Design | New Oven Nominal Design | New Oven Low Velocity Case | New Oven High Velocity Case |
|---|---|---|---|---|---|
| Heat Delivered | BTU/hr | 1,595,217 | 1,595,217 | 1,595,217 | 1,595,217 |
| Momentum Delivered | ft lbm/sec2 | 1,365 | 1,365 | 836 | 1,643 |
| Delivery Volume - Actual | acfm | 30,000 | 6,000 | 6,000 | 6,000 |
| Delivery Volume - Standard | scfm | 17,584 | 2,000 | 2,000 | 2,000 |
| Air Delivery Temperature | F. | 444 | 1,100 | 1,100 | 1,100 |
| Number of Nozzles | | 72 | 72 | 44 | 97 |
| Nozzle Diameter | in | 4.528 | 0.676 | 1.100 | 0.531 |
| Air Velocity at Nozzle | fpm | 3,727 | 32,000 | 20,000 | 40,000 |
| Nozzle Velocity/Volume | 1/ft2 | 9 | 401 | 150 | 650 |
| Nozzle Velocity/Area | 1/ft-sec | 556 | 219,000 | 50,000 | 427,000 |
| Air Volume/Oven Length | scfm/ft | 220 | 25 | 25 | 25 |

The data shown in Table 1 is based upon a typical 80 foot long oven section (i.e., heat up zone) at a typical vehicle body 34 production rate. In each example, the required heat delivery is about 1,595,000 BTU/hr. The first column shows the various operating requirements to produce the heat required in a conventional oven design and the following columns indicate the inventive oven nominal design, with a lower limit velocity and an upper limit velocity establishing the general operating range.

Most notably, a significant reduction in the standard delivery volume is realized in standard cubic feet per minute (ambient temperature). Those of skill in the art will understand that delivery volume in a conventional oven is generally 30,000 acfm because hot air is recirculated through the oven by the heater box 12 shown in FIG. 1. Therefore the reduction in delivery volume enabling a significant reduction in fan capacity is actually from 30,000 acfm to 2,000 scfm. To maintain the required heat delivery at the reduced delivery volume, the air delivery temperature at the nozzles 56 is increased to about 1,100° F. in the new oven design exceeding the conventional air delivery temperature at a conventional nozzle 22 of about 444° F. Additionally, the nozzle diameter is reduced from a conventional diameter of about 0.38 feet to about 0.06 feet resulting in an increase in air velocity at the nozzle from 3,727 fpm to about 32,000 fpm in the nominal oven assembly 30. This provides a nominal nozzle velocity per area of nozzle of about 219,000 ft-sec, much higher than the conventional nozzle velocity per area of about 556 ft-sec. Therefore, the inventors have determined that a momentum requirement for delivering heat energy remains constant when pressurized air is delivered at up to three times higher than the curing temperature of the coating applied to the vehicle body at higher air velocities and significantly lower delivery volume. Based upon studies, it is believed that temperatures of between two and four times the curing temperature in Fahrenheit degrees with a coating applied to the vehicle body is a preferred operating range while still providing enough heat energy to cure or bake the coating applied to the vehicle body. Furthermore, the ratio set forth above makes use of an air velocity to air volume ratio at the nozzles 56 of between about 150 and 650 to 1, with a nominal ratio of about 400 to 1. Furthermore, the ratio of air velocity in feet per second to a nozzle area is determined to be between about 50,000 and 400,000 to 1, with a nominal velocity of about 220,000 to 1.

Further operating parameters proven to achieve desired heat and momentum requirements include providing the volume of air to the oven housing at less than about 25 scfm per foot of oven housing. An alternate embodiment provides a volume of air to the oven housing of less than about 50 scfm per foot of oven housing. A still further alternate embodiment provides a volume of air to the oven housing at a rate of about 75 scfm per foot of oven housing. This is significantly less than a conventional oven design which requires about 220 scfm per foot oven length, requiring higher energy usage than the inventive oven assembly 30.

An additional benefit of heating the pressurized air to about 1,100° F. is the ability to clean the oven 30 by combustion of coating byproducts known to coat oven walls. This eliminates the need to manually wash oven walls, which is labor intensive.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A method of curing a coating applied to an object passing through an oven housing, where said coating has a curing temperature of about T in degrees Fahrenheit; comprising the steps of:

providing a source of pressurized air, said source of pressurized air drawing air from outside said oven housing and delivering the pressurized air to said oven;

heating the pressurized air with a heater located adjacent the oven housing to a temperature of between about two and four times the curing temperature of the coating T in degrees Fahrenheit; and directing the pressurized air having a temperature of between two and four times T in degrees Fahrenheit toward predetermined locations on the object thereby raising the temperature of the object to about T degrees Fahrenheit for a duration necessary to cure the coating applied to the object.

2. The method set forth in claim 1, wherein said step of delivering pressurized air to said oven housing is further defined by delivering pressurized air velocity to air volume ratio of between about 150 and 650 to one.

3. The method set forth in claim 1, wherein said step of delivering pressurized air to said oven housing is further defined by delivering pressurized air velocity to air volume ratio of about 400 to one.

4. The method as set forth in claim 1, wherein said step of drawing air from outside said oven housing is further defined by drawing substantially all of the air delivered to said oven housing from outside said oven housing.

5. The method as set forth in claim 1, further including the step of insulating the heated air from the interior of said oven housing prior to transferring the heated air into said oven housing.

6. The method as set forth in claim 1, wherein said step of delivering pressurized air to said oven housing is further defined by delivering an air volume of less than about 25 scfm per foot of oven housing.

7. The method as set forth in claim 1, wherein said step of delivering pressurized air to said oven housing is further defined by delivering an air volume of less than about 50 scfm per foot of oven housing.

8. The method as set forth in claim 1, wherein said step of delivering pressurized air to said oven housing is further defined by delivering an air volume of about 75 scfm per foot of oven housing.

9. The method as set forth in claim 1, wherein said step of heating the pressurized air is further defined by applying combustion gases directly to the pressurized air.

10. A method of curing a coating on a vehicle body, wherein the coating has a curing temperature T in degrees Fahrenheit, comprising the following steps:

conveying the vehicle body through an oven having an enclosed oven housing;

directing air under pressure to a heater located adjacent the oven housing;

heating the pressurized air in the heater to a temperature equal to two to four times the curing temperature T in degrees Fahrenheit; and directing heated pressurized air into channels within the oven housing having a plurality of spaced nozzles directing heated air at a nozzle velocity of 20,000 to 40,000 feet per minute onto the vehicle bodies conveyed through the oven for a time sufficient to cure the coating on the vehicle body.

* * * * *